US010183482B2

(12) United States Patent
Kobayashi

(10) Patent No.: US 10,183,482 B2
(45) Date of Patent: Jan. 22, 2019

(54) LIGHT IRRADIATION APPARATUS WITH COOLING MECHANISM

(71) Applicant: HOYA CANDEO OPTRONICS CORPORATION, Toda-shi, Saitama (JP)

(72) Inventor: Norio Kobayashi, Toda (JP)

(73) Assignee: HOYA CANDEO OPTRONICS CORPORATION, Toda-Shi, Saitama (JP)

( * ) Notice: Subject to any disclaimer, the term of this patent is extended or adjusted under 35 U.S.C. 154(b) by 251 days.

(21) Appl. No.: 14/799,150

(22) Filed: Jul. 14, 2015

(65) Prior Publication Data

US 2016/0016337 A1 Jan. 21, 2016

(30) Foreign Application Priority Data

Jul. 18, 2014 (JP) ..... 2014-147246

(51) Int. Cl.
*B41F 23/04* (2006.01)

(52) U.S. Cl.
CPC ..... *B41F 23/0409* (2013.01); *B41F 23/04* (2013.01)

(58) Field of Classification Search
CPC ..... B41F 23/0409; B41F 23/04
USPC ..... 362/294
See application file for complete search history.

(56) References Cited

U.S. PATENT DOCUMENTS

2008/0257186 A1* 10/2008 Kusaka ..... B41F 21/102 101/424.1
2012/0133716 A1* 5/2012 Aizawa ..... B41F 23/0453 347/102
2013/0182436 A1 7/2013 Payne et al.

FOREIGN PATENT DOCUMENTS

| | | | |
|---|---|---|---|
| JP | 2011-154855 | A | 8/2011 |
| JP | 2012-182063 | A | 9/2012 |
| JP | 2012-182068 | A | 9/2012 |
| JP | 2013-252720 | A | 12/2013 |
| TW | 2011-13164 | A | 4/2011 |
| TW | 2013-46176 | A | 11/2013 |

* cited by examiner

*Primary Examiner* — Anh Mai
*Assistant Examiner* — Hana Featherly
(74) *Attorney, Agent, or Firm* — Rabin & Berdo, P.C.

(57) ABSTRACT

Provided is a light irradiation apparatus. The light irradiation apparatus which irradiates light of a line shape extending in a first direction and having a predetermined line width in a second direction perpendicular to the first direction, includes a substrate, a plurality of light sources placed on a surface of the substrate side by side at a predetermined interval along the first direction, with a direction of an optic axis being a third direction perpendicular to the first and second directions, a plurality of heat radiation fins standing erect on an opposite surface of the substrate and arranged in rows in the first direction, and N cooling mechanisms placed side by side along the first direction to cover a plurality of heat radiation fins, in which N is an integer greater than or equal to 2. Each of the cooling mechanisms includes a case and a cooling fan.

22 Claims, 5 Drawing Sheets

1
100
101
101a
103
105
200
301
303
305
307
X
Y
Z

LIGHT IRRADIATION APPARATUS WITH COOLING MECHANISM

TECHNICAL FIELD

The present disclosure relates to a light irradiation apparatus for irradiating light of a line shape with a plurality of light sources arranged in a line shape, and more particularly, to a light irradiation apparatus having a cooling mechanism which radiates heat generated from light sources.

BACKGROUND

Conventionally, a printing apparatus for printing using a ultraviolet (UV) ink which is cured by UV light irradiation is known. This printing apparatus ejects an ink from a nozzle of a head to a medium, and irradiates a UV light on a dot formed on the medium. By UV light irradiation, the dot is cured and settled on the medium, so good printing may be enabled for a medium which is less prone to absorb a liquid. This printing apparatus is disclosed in, for example, Patent Literature 1.

Patent Literature 1 discloses a printing apparatus including a conveyor unit for conveying a print medium, six heads arranged in a conveying direction to respectively eject color inks of cyan, magenta, yellow, black, orange, and green, six pre-curing irradiation units placed at a downstream side in the conveying direction between each head for pre-curing (peening) a dot ink ejected on the print medium from each head, and a curing irradiation unit for curing the dot ink to settle the dot ink on the print medium. The printing apparatus disclosed in Patent Literature 1 performs two-steps curing of pre-curing and curing, on the dot ink to prevent a blurred color ink or dot expansion.

The pre-curing irradiation unit disclosed in Patent Literature 1 is placed above the print medium and irradiates a UV light on the print medium, hence it is a so-called UV light irradiation device, and irradiates a UV light of a line shape in a widthwise direction of the print medium. In response to a request for a lightweight and compact design of the printing apparatus itself, the pre-curing irradiation unit uses a light emitting diode (LED) as a light source, and a plurality of LEDs is arranged side by side along the widthwise direction of the print medium.

As described above, in the case where an LED is used as a light source, there is a degradation problem of light emitting efficiency and life caused by heat generated from the LED itself in that most of the power supplied is converted to heat. Also, like the pre-curing irradiation unit, in the case of an apparatus having a plurality of LEDs mounted therein, this problem is more serious in terms of the increased number of LEDs acting as a heat source. By this reason, a light irradiation apparatus using an LED as a light source is generally configured to inhibit the heat generation of the LED using a cooling structure such as a heat sink (for example, Patent Literature 2).

The light irradiation apparatus (light source apparatus) disclosed in Patent Literature 2 includes a plurality of LEDs, radiators thermally coupled to the LEDs respectively, and a fan that sends a cooling airflow along an arrangement direction of the radiators, and efficiently cools the radiators (i.e., the LEDs) by the airflow generated by the fan.

RELATED LITERATURES

Patent Literatures (Patent Literature 1) Japanese Patent Unexamined Publication No. 2013-252720

(Patent Literature 2) Japanese Patent Unexamined Publication No. 2011-154855

DISCLOSURE

Technical Problem

However, because the light irradiation apparatus of Patent Literature 2 is designed to flow air cooling the radiators in only one direction along the arrangement direction of the radiators (that is, along the arrangement direction of the light emitting diodes (LEDs)), air increases in temperature each time the air passes through the radiators, and as a consequence, a temperature difference occurs between the radiators (that is, the LEDs) arranged at an upstream side of the airflow and the radiators (that is, the LEDs) arranged at a downstream side. Generally, because the irradiation intensity of the LEDs has temperature-dependent characteristics, when a temperature difference occurs between the LEDs arranged in a line shape, non-uniformity of irradiation intensity occurs due to the temperature difference.

In this circumstance, the present disclosure aims to provide a light irradiation apparatus for emitting light of a line shape with a small temperature difference between LEDs and approximately uniform irradiation intensity.

Technical Solution

To achieve the object, a light irradiation apparatus of the present disclosure is a light irradiation apparatus that irradiates, on an irradiation surface, light of a line shape extending in a first direction and having a predetermined line width in a second direction perpendicular to the first direction, and the light irradiation apparatus includes a substrate, a plurality of light sources placed on a surface of the substrate side by side at a predetermined interval along the first direction, with a direction of an optic axis being a third direction perpendicular to the first direction and the second direction, a plurality of heat radiation fins standing erect on an opposite surface of the substrate and arranged in rows in the first direction, and N cooling mechanisms placed side by side along the first direction to cover a plurality of heat radiation fins, in which N is an integer greater than or equal to 2, and each of the cooling mechanisms includes a case to receive a portion of the plurality of heat radiation fins and form a wind tunnel surrounding the portion of the plurality of heat radiation fins, and a cooling fan to bring air from outside, introduce the air to the wind tunnel, and generate an airflow in the first direction within the wind tunnel.

According to this construction, because the plurality of heat radiation fins is cooled approximately simultaneously, the plurality of heat radiation fins may be cooled uniformly and efficiently. Thus, the plurality of light sources placed on the substrate is also uniformly cooled, a temperature difference between each light source is significantly reduced, and a ultraviolet (UV) light of a line shape is emitted from the light irradiation apparatus with approximately uniform irradiation intensity.

Also, the case may include an intake opening for bringing the air from outside, and an exhaust opening for exhausting the air having passed through the wind tunnel, and the cooling fan may preferably be provided in at least one of the intake opening and the exhaust opening.

Also, the case may preferably be configured to have a space between the intake opening and the wind tunnel to cause the air from outside to be in a constant flow. According to this construction, air may be supplied to each heat radiation fin approximately uniformly.

Also, the case may preferably have dividers to divide the space and the wind tunnel.

Also, the intake opening and the exhaust opening of each of the cooling mechanisms may preferably be open to the third direction.

Also, the N may preferably be 2, and the exhaust opening of each of the cooling mechanisms may preferably be placed closer to the substrate than the intake opening, and is open to the first direction. Also, in this case, the intake opening of each of the cooling mechanisms may be configured to be open to the first direction. Also, the intake opening of each of the cooling mechanisms may be configured to be open to the third direction.

Also, the light source may be composed of at least one LED device.

Also, the light may preferably be light including a wavelength applicable to an ultraviolet curable resin.

Advantageous Effects

As described above, according to the present disclosure, a light irradiation apparatus is implemented, which may emit light of a line shape with a small temperature difference between light emitting diodes (LEDs) and approximately uniform irradiation intensity.

DETAILED DESCRIPTION

Figures 1A, 1B, 1C, 1D:
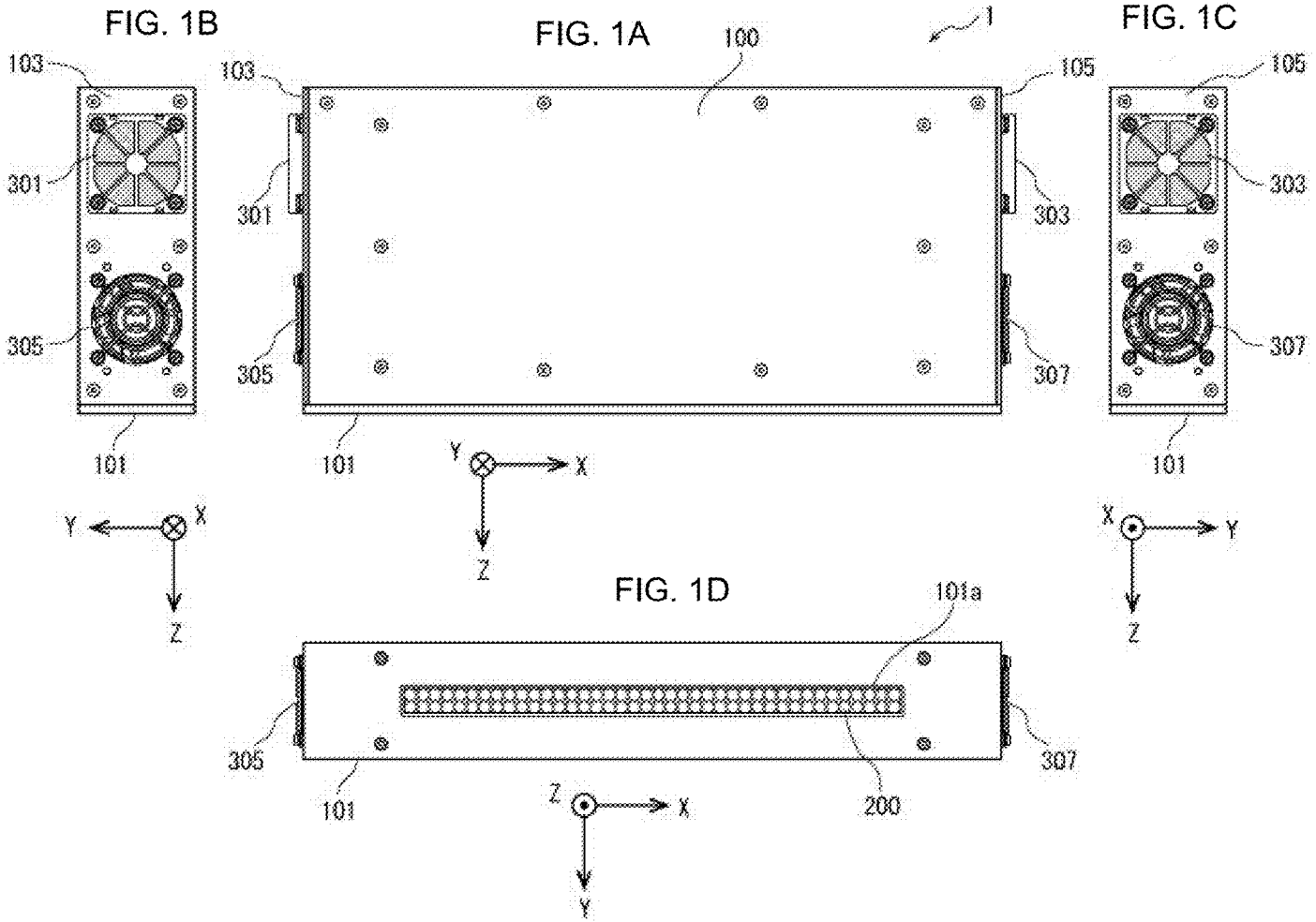
FIGS. 1A to 1D are, respectively, an exterior diagram illustrating components of a light irradiation apparatus according to a first embodiment of the present disclosure.

Hereinafter, the embodiments of the present disclosure will be described in detail with reference to accompanying drawings. In the drawings, like or equivalent parts are given like reference numerals, and its description is not repeated.

First Embodiment

FIGS. 1A to 1D are, respectively, an exterior diagram illustrating components of a light irradiation apparatus 1 according to a first embodiment of the present disclosure, FIGS. 1A through 1D are a top view, a left side view, a right side view, and a front view of the light irradiation apparatus 1 according to the first embodiment of the present disclosure, respectively. Also, FIGS. 2A to 2C are, respectively, a diagram illustrating an internal structure of the light irradiation apparatus 1 according to the first embodiment of the present disclosure, FIG. 2A is a diagram illustrating a shape of an outer case 100 of the light irradiation apparatus 1 when separated, FIG. 2B is a longitudinal cross-sectional view taken along the line A-A in 2A, and FIG. 2C is a transverse cross-sectional view of FIG. 2A. The light irradiation apparatus 1 of this embodiment is an apparatus that is mounted in a printing apparatus for printing using a UV ink which is cured by ultraviolet (UV) light irradiation, and is placed facing a print medium (not shown) and irradiates a UV light of a line shape in a widthwise direction of the print medium (that is, a direction perpendicular to a conveying direction of the print medium). Also, in the specification, for the convenience of description, a description is hereinafter provided under the definition that a lengthwise (linear) direction of a UV light of a line shape emitted from the light irradiation apparatus 1 is an X-axis direction, and a widthwise direction (that is, a vertical direction in FIG. 1D) is a Y-axis direction, a direction perpendicular to the X axis and the Y axis (that is, a direction of the UV light emission) is a Z-axis direction. Also, in FIGS. 2A and 2C, for the convenience of description, the outer case 100 is shown in a dotted line, and in FIG. 2C, a cooling airflow flowing in spaces R1 and R2 within a wind tunnel case 310 is shown in an arrow.

As shown in FIGS. 1A to 1D and 2A to 2C, the light irradiation apparatus 1 of this embodiment includes a light irradiation unit 200 to emit a UV light of a line shape, a cooling apparatus 300 to cool the light irradiation unit 200, a box-shaped outer case 100 of a metal (for example, aluminum) to receive the light irradiation unit 200 and the cooling apparatus 300. Also, intake fans 301 and 303 which takes air into the outer case 100 and exhaust fans 305 and 307 which exhaust air from the inside of the outer case 100 are exposed from a left side panel 103 and a right side panel 105 of the outer case 100.

Figure 2A:
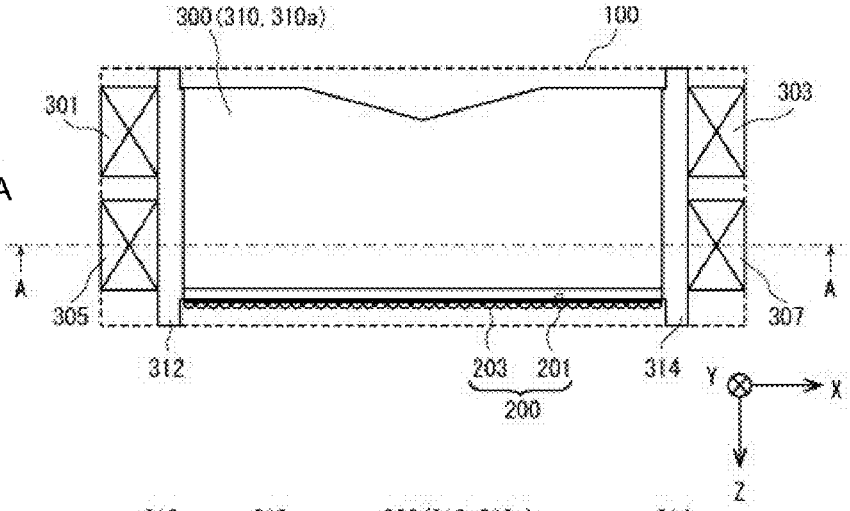
FIGS. 2A to 2C are, respectively, a diagram illustrating an internal structure of a light irradiation apparatus according to a first embodiment of the present disclosure.
Figure 2B:
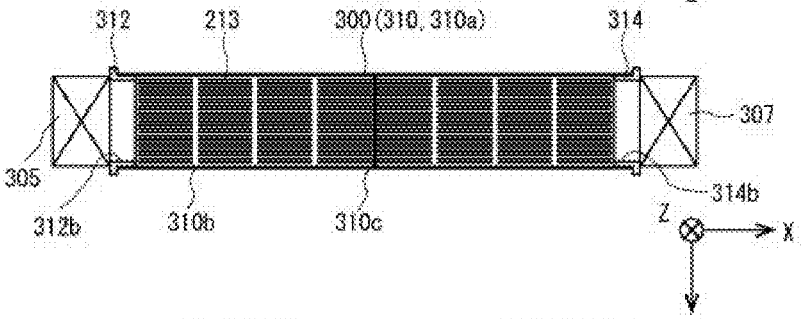
Figure 2C:
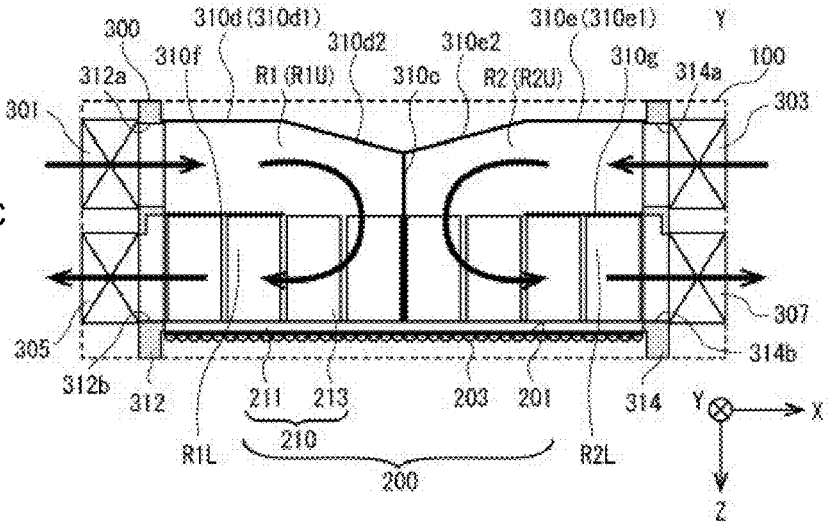

As shown in FIG. 1D, at the center of a front panel 101 of the outer case 100, a light emitting window 101*a* of a rectangular shape covered with a cover glass (not shown) is formed, and at the inside of the light emitting window 101*a*, a light irradiation unit 200 which emits a UV light of a line shape along the X-axis direction is placed.

As shown in FIGS. 1D, 2A, and 2C, the light irradiation unit 200 of this embodiment has a substrate 201 of a rectangular shape parallel to the X-axis direction and the Y-axis direction, a plurality of light emitting diode (LED) devices (light sources) 203 placed on the substrate 201, and a heat sink 210.

The substrate 201 is a wiring substrate of a rectangular shape formed from a material having high thermal conductivity (for example, aluminum nitride), and on its surface, 40 (X-axis direction)×2 (Y-axis direction) LED devices 203 are mounted in a square lattice shape along the X-axis direction and the Y-axis direction (FIG. 1D). Also, on the substrate 201, an anode pattern (not shown) and a cathode pattern (not shown) for supplying power to each LED device 203 are formed, and each LED device 203 is soldered and electrically connected to each of the anode pattern and the cathode pattern. The anode pattern and the cathode pattern are electrically connected to an LED driver circuit (not shown), and a drive current from the LED driver circuit is supplied to each LED device 203 by the medium of the anode pattern and the cathode pattern.

The LED device 203 has a LED chip (not shown) having a light emitting surface of an approximately square shape, and is a semiconductor device that emits a UV light of 365 nm wavelength when supplied with the drive current from the LED driver circuit. When the drive current is supplied to each LED device 203, a UV light is emitted from each LED device 203 in a light amount based on the drive current, and a UV light of a line shape approximately parallel in the X-axis direction is emitted from the light irradiation apparatus 1. Also, for each LED device 203 of this embodiment, the drive current being supplied to each LED device 203 is adjusted to emit a UV light in an approximately uniform light amount, and the UV light of a line shape emitted from the light irradiation apparatus 1 has an approximately uniform light amount distribution in the X-axis direction and the Y-axis direction.

The heat sink 210 is a member that is placed in close contact with an opposite surface (a surface on an opposite side to a surface where the LED devices 203 are mounted) of the substrate 201, and radiates heat generated from each LED device 203, and is integrally formed from a material having good thermal conductivity such as aluminum or copper (FIG. 2C). The heat sink 210 of this embodiment includes a base plate 211 contacting the opposite surface of the substrate 201, and a plurality of heat radiation fins 213 formed to protrude to the negative side of the Z-axis direction from the base plate 211 (FIGS. 2B and 2C). When a drive current flows in each LED device 203 and a UV light is emitted from each LED device 203, the temperature rises by self-heat generation of the LED devices 203 and a problem of significantly reduced light emitting efficiency occurs, and thus, in this embodiment, the heat sink 210 is provided in close contact with the opposite surface of the substrate 201, and heat generated from the LED devices 203 is conducted to the heat sink 210 through the substrate 201 and is forcibly radiated. Also, as a material for the heat sink 210, alloys such as aluminum alloys or copper alloys may be used, and in addition to metals, ceramics (for example, aluminum nitride or silicon nitride) or resin (for example, polyphenylene sulfide (PPS) containing thermally conductive fillers such as metal powder) may be also used.

The base plate 211 is a member of a rectangular plate shape, and its lower surface (a surface facing the opposite surface of the substrate 201) is closely adhered to the opposite surface of the substrate 201, for example, with a heat radiating grease or an adhesive having high thermal conductivity. Thus, the heat generated from the LED devices 203 is quickly conducted to the base plate 211.

Also, as shown in FIGS. 2B and 2C, on an upper surface of the base plate 211 of this embodiment, twenty three heat radiation fins 213 extending along the X-axis direction are divided into eight rows along the X-axis direction, and stand erect at equidistant intervals in the Y-axis direction. Because the heat radiation fins 213 are integrally formed with the base plate 211, the heat conducted to the base plate 211 is quickly conducted to the heat radiation fins 213. Also, as described below, while a cooling airflow generated by the cooling apparatus 300 passes in between the heat radiation fins 213, the heat conducted to the heat radiation fins 213 is efficiently radiated in the air.

As shown in FIG. 2C, the cooling apparatus 300 is an apparatus that is provided to surround the heat radiation fins 213 to cool the heat radiation fins 213 by flowing cooling air along the heat radiation fins 213. As shown in FIGS. 2A-2C, the cooling apparatus 300 of this embodiment includes a wind tunnel case 310 surrounding the heat radiation fins 213, intake fans 301 and 303 to send cooling air into the wind tunnel case 310, exhaust fans 305 and 307 to exhaust air from the inside of the wind tunnel case 310, and a pair of arms 312 and 314 to support and hold the wind tunnel case 310, the intake fans 301 and 303, the exhaust fans 305 and 307.

The pair of arms 312 and 314 are a metal member (for example, aluminum) of a rectangular rod shape extending along the Z-axis direction, and the light irradiation unit 200 and the wind tunnel case 310 are fixed between the arms 312 and 314 (FIG. 2A). Also, the intake fans 301 and 303 and the exhaust fans 305 and 307 are attached to the outside in the X-axis direction of the pair of arms 312 and 314.

The wind tunnel case 310 is a metal member (for example, aluminum) covering the heat radiation fins 213, and as shown in FIGS. 2B and 2C, includes a first side panel 310*a*, a second side panel 310*b*, a partition 310*c*, rear panels 310*d* and 310*e*, and a first divider 310*f* and a second divider 310*g*.

The first side panel 310*a* and the second side panel 310*b* are a member of an approximately rectangular plate shape provided to clamp the heat radiation fins 213 from both sides of the Y-axis direction, and are respectively connected to the pair of arms 312 and 314 and fastened by bolt tightening or the like. Also, the proximal end of the first side panel 310*a* and the second side panel 310*b* (an end on the positive side of the Z-axis direction) comes into contact with the upper surface of the base plate 211 (that is, the surface where the heat radiation fins 213 stand erect) and the distal end (an end on the negative side of the Z-axis direction) is connected to the rear panels 310*d* and 310*e* and fastened by bolt tightening or the like.

The partition 310*c* is a plate-shaped member that is vertically placed between the first side panel 310*a* and the second side panel 310*b* and divides a space within the wind tunnel case 310 into two spaces R1 and R2 along the X-axis direction. As shown in FIG. 2C, the partition 310*c* of this embodiment passes in between the heat radiation fins 213 in the fourth row and the heat radiation fins 213 in the fifth row from the right side and extends in the Z-axis direction, and one end comes into contact with the upper surface of the base plate 211 (that is, the surface where the heat radiation fins 213 stand erect) and the other end is connected to the rear panels 310*d* and 310*e*.

The rear panels 310*d* and 310*e* are a plate-shaped member vertically placed between the first side panel 310*a* and the second side panel 310*b*. The rear panel 310*d* is bent in the shape of '<' when viewed in the Y-axis direction, and includes a first linear part 310*d*1 extending parallel in the X-axis direction and a second linear part 310*d*2 inclined relative to the X-axis direction. One end of the rear panel 310*d* (a proximal end of the first linear part 310*d*1) is connected to the arm 312, and the other end (a distal end of the second linear part 310*d*2) is connected to the partition 310*c* and the rear panel 310*e*. Similar to the rear panel 310*d*, the rear panel 310*e* is bent in the shape of '<' when viewed in the Y-axis direction, and includes a first linear part 310*e*1 extending parallel in the X-axis direction and a second linear part 310*e*2 inclined relative to the X-axis direction. One end of the rear panel 310*e* (a proximal end of the first linear part 310*e*1) is connected to the arm 314, and the other end (a distal end of the second linear part 310*e*2) is connected to the partition 310*c* and the rear panel 310*d*.

The first divider 310*f* is a plate-shaped member that is vertically placed between the first side panel 310*a* and the second side panel 310*b* and divides the space R1 into two spaces R1U and R1L in the Z-axis direction. As shown in FIG. 2C, the first divider 310*f* of this embodiment is connected at its one end to the arm 312, extends in the X-axis direction along the distal end of the heat radiation fins 213 in the first and second rows from the left side, and is configured to receive the heat radiation fins 213 in the space R1L.

The second divider 310*g* is a plate-shaped member that is vertically placed between the first side panel 310*a* and the second side panel 310*b* and divides the space R2 into two spaces R2U and R2L in the Z-axis direction. As shown in FIG. 2C, the second divider 310*g* of this embodiment is connected at its one end to the arm 314, extends in the X-axis direction along the distal end of the heat radiation fins 213 in the first and second rows from the right side, and is configured to receive the heat radiation fins 213 in the space R2L.

The arm 312 of this embodiment has an approximately circular opening 312*a* (intake) formed at a location corresponding to the space R1U, and an approximately circular opening 312*b* (exhaust) formed at a location corresponding to the space R1L. Also, the intake fan 301 is attached to the outside of the opening 312*a*, and the exhaust fan 305 is attached to the outside of the opening 312*b*. Thus, when the intake fan 301 and the exhaust fan 305 rotate, air from outside is brought into the space R1 along the X-axis direction to generate a cooling airflow as indicated by an arrow in FIG. 2C. Specifically, when air from outside is brought into the space R1U by the intake fan 301, the intake air travels in the X-axis direction along the first divider 310*f* and is in a constant flow within the space R1U. Also, when the air in the space R1U collides with the second linear part 310*d*2 of the rear panel 310*d* and the partition 310*c*, the air is sent to the space R1L and exhausted to the outside by the exhaust fan 305 through the heat radiation fins 213 placed in the space R1L. Like this, in this embodiment, the space R1U acts as a space for a constant flow of air, and the space R1L acts as a wind tunnel to cool the heat radiation fins 213.

Similar to the arm 312, the arm 314 of this embodiment has an approximately circular opening 314*a* (intake) formed at a location corresponding to the space R2U, and an approximately circular opening 314*b* (exhaust) formed at a location corresponding to the space R2L. Also, the intake fan 303 is attached to the outside of the opening 314*a*, and the exhaust fan 307 is attached to the outside of the opening 314*b*. Thus, when the intake fan 303 and the exhaust fan 307 rotate, air from outside is brought into the space R2 along the X-axis direction to generate a cooling airflow as indicated by an arrow in FIG. 2C. Specifically, when air from outside is brought into the space R2U by the intake fan 303, the intake air travels in the X-axis direction along the second divider 310*g* and is in a constant flow within the space R2U. Also, when the air in the space R2U collides with the second linear part 310*e*2 of the rear panel 310*e* and the partition 310*c*, the air is sent to the space R2L and exhausted to the outside by the exhaust fan 307 through the heat radiation fins 213 placed in the space R2L. Like this, in this embodiment, the space R2U acts as a space for a constant flow of air, and the space R2L acts as a wind tunnel to cool the heat radiation fins 213.

As described above, the cooling apparatus 300 of this embodiment cools the heat radiation fins 213 respectively placed in the spaces R1L and R2L approximately simultaneously by dividing the space within the wind tunnel case 310 into the two spaces R1 and R2 along the X-axis direction, and generating a cooling airflow in each of the spaces R1 and R2 (that is, by two cooling mechanisms). By this reason, the cooling apparatus 300 of this embodiment has a cooling capacity about twice larger than that of a cooling structure of cooling in an airflow flowing in only one direction within one space according to a prior art, and enables uniform and efficient cooling of the heat radiation fins 213. Accordingly, the plurality of LED devices 203 placed on the substrate 201 is uniformly cooled, a temperature difference between each LED device 203 is significantly reduced, and a UV light of a line shape is emitted from the light irradiation apparatus 1 with approximately uniform irradiation intensity.

Figure 3:
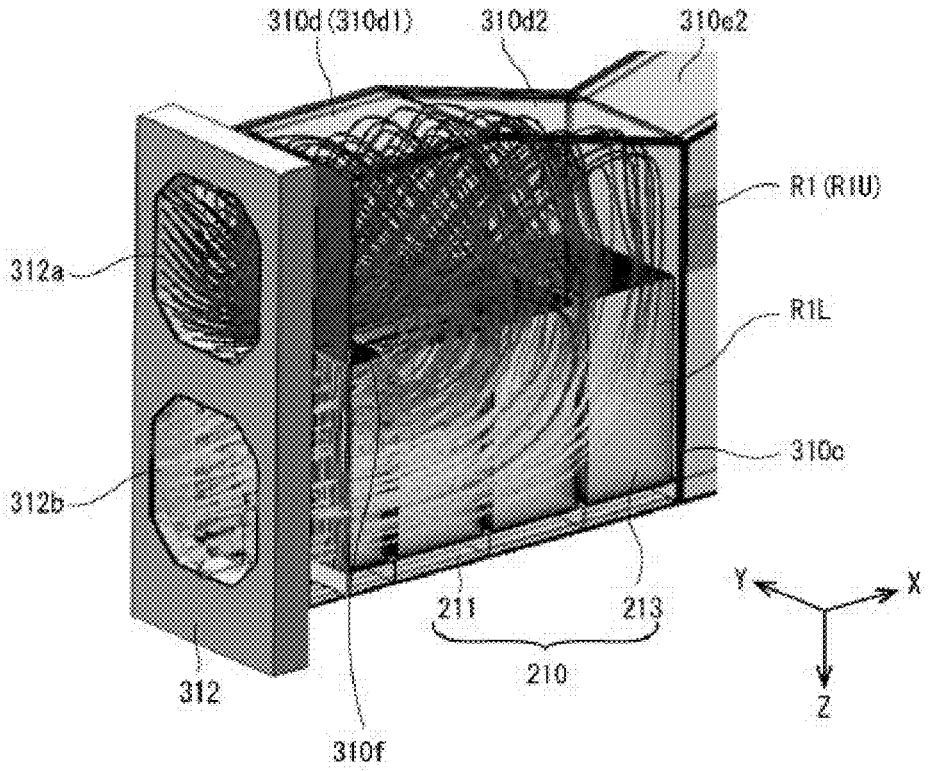
FIG. 3 is a perspective (projection) view illustrating a simulation result of a cooling airflow generated in a cooling apparatus of a light irradiation apparatus according to a first embodiment of the present disclosure.

FIG. 3 is a perspective (projection) view illustrating a result of simulating a shape of a cooling airflow generated in the space R1 within the wind tunnel case 310 of the cooling apparatus 300 of this embodiment. Also, in FIG. 3, to improve readability of the drawing, the intake fan 301, the exhaust fan 305, the light irradiation unit 200, and the outer case 100 are omitted.

As shown in FIG. 3, according to the construction of this embodiment, it can be seen that because a portion of the air blown into the space R1U is in a constant flow within the space R1U and invades the innermost side (that is, the partition 310*c* side) along the X-axis direction, the heat radiation fins 213 placed at the side close to the partition 310*c* may be sufficiently cooled. Also, because a portion of the air blown into the space R1U does not invade the innermost side (that is, the partition 310*c* side) along the X-axis direction, and flows into the space R1L passing around the first divider 310*f*, it can be seen that the heat radiation fins 213 placed at the side apart from the partition 310*c* may be also sufficiently cooled.

Figure 4:
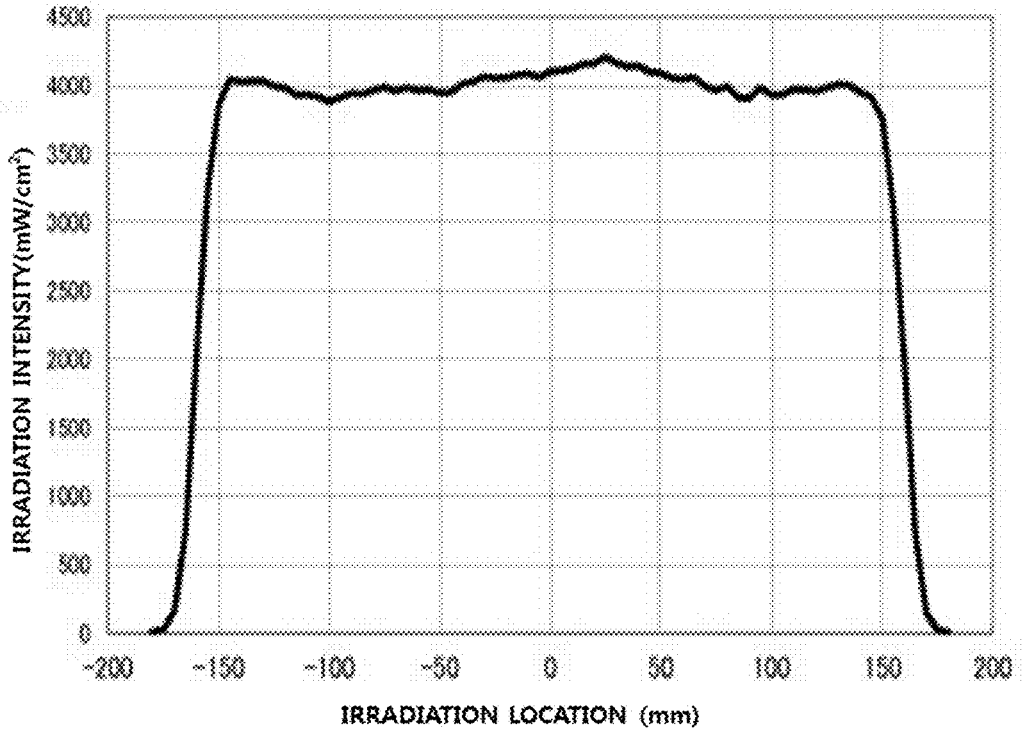
FIG. 4 shows an irradiation intensity distribution of a ultraviolet (UV) light emitted from a light irradiation apparatus according to a first embodiment of the present disclosure.

FIG. 4 shows an irradiation intensity distribution in the X-axis direction when a UV light of a line shape emitted from the light irradiation apparatus 1 of this embodiment is irradiated on a print medium (a target to be irradiated) placed 10 mm apart from the light emitting window 101*a* of the light irradiation apparatus 1. A horizontal axis of FIG. 4 is the irradiation location (mm) when a center in a lengthwise direction (X-axis direction) of the UV light of a line shape is set as 0 mm, and a vertical axis is the irradiation intensity ($mW/cm^2$) of the UV light on the print medium. As shown in FIG. 4, according to the construction of this embodiment, it can be seen that a UV light of a line shape is emitted from the light irradiation apparatus 1 with approximately uniform irradiation intensity (about 4000 $mW/cm^2$).

While this embodiment has been described hereinabove, the present disclosure is not limited to the above construction and a variety of changes and modifications may be made within the technical aspect and scope of the invention.

For example, although it is described that 40 (X-axis direction)×2 (Y-axis direction) LED devices 203 are mounted on the substrate 201 in the light irradiation unit 200 of this embodiment, the number of LED devices 203 arranged in the X-axis direction and the Y-axis direction may be suitably increased or decreased based on the required specification. Also, each LED device 203 may be configured to have a plurality of LED chips (dies) inside.

Also, although it is described that the LED devices 203 of this embodiment emits a UV light of 365 nm wavelength, they may be those that emit a UV light of another wavelength and visible light or infrared light, and the purpose of use of the light irradiation apparatus 1 is not limited to a printing apparatus for printing using a UV ink.

Also, although the cooling apparatus 300 of this embodiment is configured to have the intake fan 301 and the exhaust fan 305 for the space R1 and the intake fan 303 and the exhaust fan 307 for the space R2, as long as a predetermined cooling airflow is generated in the spaces R1 and R2, at least one of the intake fan and the exhaust fan may be provided for each of the spaces R1 and R2.

Also, although this embodiment describes that the outer case 100 and the wind tunnel case 310 are separately formed, the two cases may be integrally formed.

Second Embodiment

Figure 5:
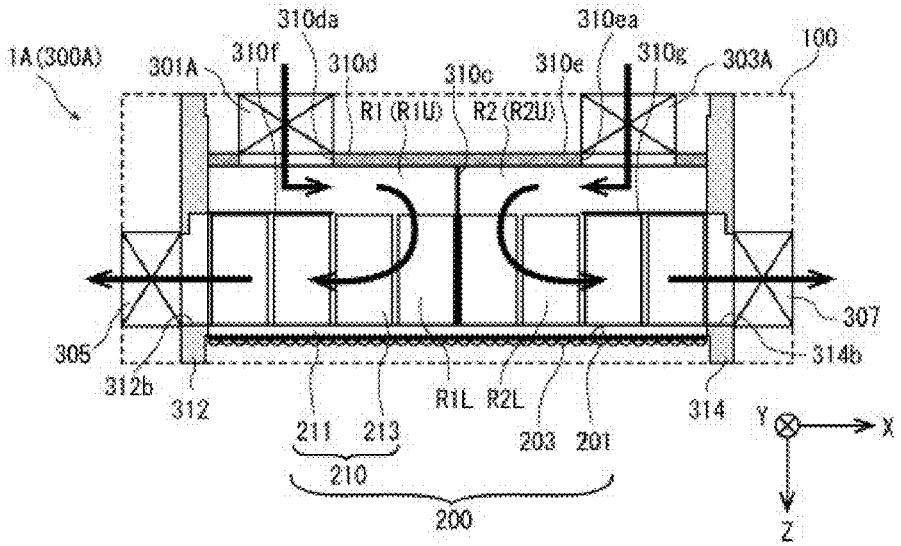
FIG. 5 is a transverse cross-sectional view of a light irradiation apparatus according to a second embodiment of the present disclosure.

FIG. 5 is a transverse cross-section view of a light irradiation apparatus 1A of a second embodiment of the present disclosure. As shown in FIG. 5, the light irradiation apparatus 1A of this embodiment is different from the light irradiation apparatus 1 of the first embodiment in that intake fans 301A and 303A of a cooling apparatus 300A are respectively attached to an opening 310*da* formed in a rear panel 310*d* and an opening 310*ea* formed in a rear panel 310*e*, and a direction of air intake from outside is the Z-axis direction.

In this embodiment, air from outside is brought into the space R1U (or R2U) by the intake fan 301 (or 303), and is in a constant flow within the space R1U (or R2U). Also, the air in the space R1U (or R2U) is sent to the space R1L (or R2L), passes in between the heat radiation fins 213 placed in the space R1L (or R2L), and is exhausted to the outside by the exhaust fan 305 (or 307). Thus, according to the construction of this embodiment, because the heat radiation fins 213 respectively placed in the spaces R1L and R2L are cooled approximately simultaneously, uniformly, and efficiently, the plurality of LED devices 203 placed on the substrate 201 are also uniformly cooled, a temperature difference between each LED device 203 is small, and a UV light of a line shape is emitted from the light irradiation apparatus 1A with approximately uniform irradiation intensity.

Third Embodiment

Figure 6:
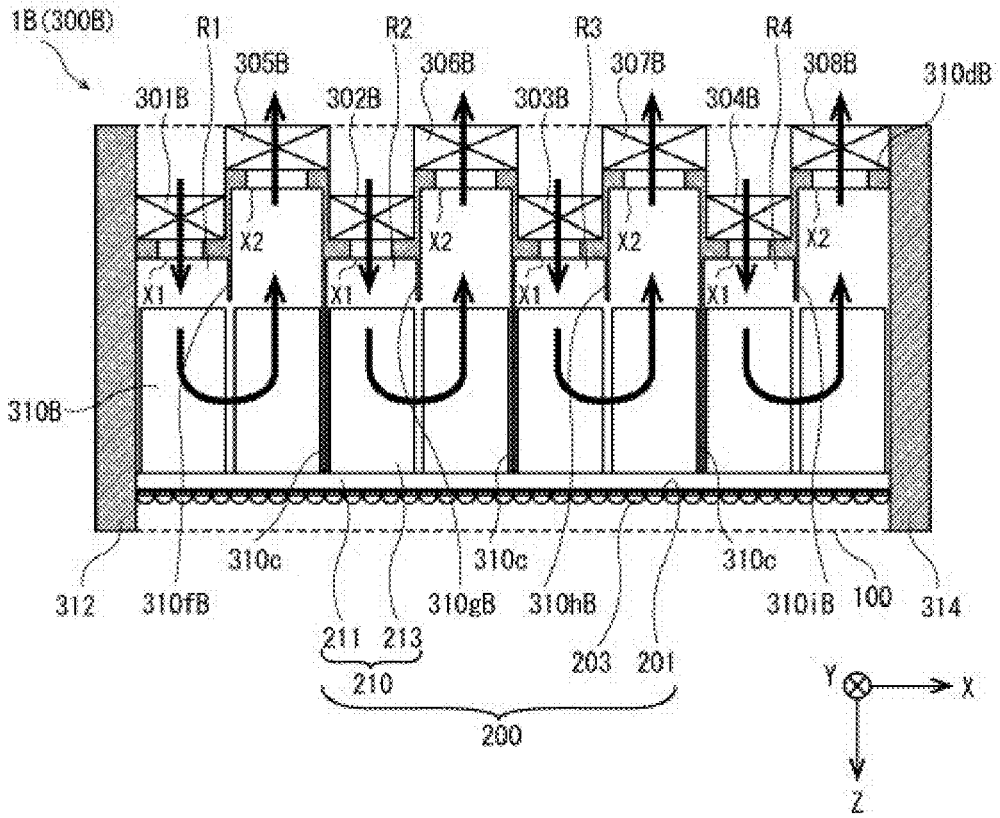
FIG. 6 is a transverse cross-sectional view of a light irradiation apparatus according to a third embodiment of the present disclosure.

FIG. 6 is a transverse cross-section view a light irradiation apparatus 1B of a third embodiment of the present disclosure. As shown in FIG. 6, the light irradiation apparatus 1B of this embodiment is different from the light irradiation apparatus 1 according to the first embodiment and the light irradiation apparatus 1A according to the second embodiment in that a space within a wind tunnel case 310B of a cooling apparatus 300B is divided into four spaces R1, R2, R3, and R4 along the X-axis direction by three partitions 310*c*, and each of the spaces R1, R2, R3, and R4 is cooled (that is, having four cooling mechanisms). Also, the three partitions 310*c* of this embodiment extend from the upper surface of the base plate 211 (that is, the surface where the heat radiation fins 213 stand erect), and are respectively connected to a rear panel 310*d*B, so that the partitions 310*c* pass in between the heat radiation fins 213 in the second row and the heat radiation fins 213 in the third row from the left side, between the heat radiation fins 213 in the fourth row and the heat radiation fins 213 in the fifth row, and between the heat radiation fins 213 in the sixth row and the heat radiation fins 213 in the seventh row, respectively.

As shown in FIG. 6, the cooling apparatus 300B of the light irradiation apparatus 1B of this embodiment has the rear panel 310*d*B integrally formed to connect the pair of arms 312 and 314. The rear panel 310*d*B of this embodiment is in a rectangular shape bent in a zigzag form at equidistant intervals, and on a concave surface protruding to the positive side of the Z-axis direction, intake openings (through-holes) X1 are formed to blow air from outside into each of the spaces R1, R2, R3, and R4, and each intake fan 301B-304B is attached to each intake opening X1. Also, on a convex surface of the rear panel 310*d*B protruding to the negative side of the Z-axis direction, exhaust openings (through-holes) X2 are formed to exhaust the air in the spaces R1, R2, R3, and R4, and each exhaust fan 305B-308B is attached to each exhaust opening X2. Also, air from outside is brought into the spaces R1, R2, R3, and R4 along the Z-axis direction, and the air in the spaces R1, R2, R3, and R4 is exhausted along the Z-axis direction. Also, in this embodiment, a location in the Z-axis direction for each intake opening X1 and a location in the Z-axis direction for each exhaust opening X2 differ, thereby preventing the high temperature air exhausted from each exhaust opening X2 from being drawn from each intake opening X1.

Also, the cooling device 300B of the light irradiation apparatus 1B according to this embodiment has dividers 310*f*B, 310*g*B, 310*h*B, and 310*i*B to divide the spaces R1, R2, R3, and R4 into two spaces in the X-axis direction. In this way, as the spaces R1, R2, R3, and R4 are divided by the dividers 310*f*B, 310*g*B, 310*h*B, and 310*i*B, air brought into the spaces R1, R2, R3, and R4 flows toward the heat radiation fins 213 placed below the spaces R1, R2, R3, and R4 (in the positive direction on the Z-axis), and the heat radiation fins 213 are thus reliably cooled.

As described above, because the heat radiation fins 213 respectively placed in the spaces R1, R2, R3, and R4 are cooled approximately simultaneously, uniformly and efficiently by the construction of this embodiment, the plurality of LED devices 203 placed on the substrate 201 is also uniformly cooled, a temperature difference between each LED device 203 is small, and a UV light of a line shape is emitted from the light irradiation apparatus 1B with approximately uniform irradiation intensity. Also, because this embodiment is configured to cool each of the spaces R1, R2, R3, and R4 (that is, configured to have four cooling mechanisms), the construction of this embodiment has a higher cooling capacity and may cool the heat radiation fins 213 more uniformly as compared to the first and second embodiments configured to cool each of the spaces R1 and R2 (that is, configured to have two cooling mechanisms). Also, although the cooling apparatus 300B of this embodiment is configured to cool the space in the wind tunnel case 310B divided into four spaces R1, R2, R3, and R4, the construction is not limited thereto, and the number of divisions is suitably set based on the required specification (that is, the degree of uniformity of UV light irradiation intensity).

It should be understood that the disclosed embodiments are meant to be exemplary and illustrative in all aspect, not limiting in scope. The scope of the invention is defined by the appended claims, not in the foregoing description, and all changes and modifications are intended to be included in the meaning and scope equivalent to the claims.

DETAILED DESCRIPTION OF MAIN ELEMENTS

1, 1A, 1B: Light irradiation apparatus, 100: Outer case, 101: Front panel, 101*a*: Light emitting window, 103: Left side panel, 105: Right side panel, 200: Light irradiation unit, 201: Substrate, 203: LED device, 210: Heat sink, 211: Base plate, 213: Heat radiation fin, 300, 300A, 300B: Cooling apparatus, 301, 303, 301B, 302B, 303B, 304B: Intake fan, 305, 307, 305B, 306B, 307B, 308B: Exhaust fan, 310: Wind tunnel case, 310*a*: First side panel, 310*b*: Second side panel, 310*c*: Partition, 310*d*, 310*e*, 310*d*B: Rear panel, 310*f*: First divider, 310*g*: Second divider, 310*f*B, 310*g*B, 310*h*B, 310*i*B: Divider, 312, 314: Arm, 312*a*, 312*b*, 314*a*, 314*b*, 310*da*, 310*ea*: Opening

The invention claimed is:

1. A light irradiation apparatus for irradiating, on an irradiation surface, light of a line shape extending in a first direction and having a predetermined line width in a second direction perpendicular to the first direction, the light irradiation apparatus comprising:

a substrate;

a plurality of light sources placed on a surface of the substrate side by side at a predetermined interval along the first direction, with a direction of an optic axis being a third direction perpendicular to the first direction and the second direction;

a plurality of heat radiation fins standing erect on an opposite surface of the substrate and arranged in rows in the first direction; and N cooling mechanisms placed side by side along the first direction to cover a plurality of heat radiation fins, in which N is an integer greater than or equal to 2, each of the cooling mechanisms comprising:

a space inside a case, the space being divided by a partition inside the case from another of the cooling mechanisms, to receive a portion of the plurality of heat radiation fins and form a wind tunnel surrounding the portion of the plurality of heat radiation fins; and a cooling fan to bring air from outside, introduce the air to the wind tunnel, and generate an airflow in the first direction within the wind tunnel.

2. The light irradiation apparatus according to claim 1, wherein the case comprises an intake opening for bringing the air from outside, and an exhaust opening for exhausting the air having passed through the wind tunnel, and the cooling fan is provided in at least one of the intake opening or the exhaust opening.

3. The light irradiation apparatus according to claim 2, wherein the case has a space between the intake opening and the wind tunnel to cause the air from outside to be in a constant flow.

4. The light irradiation apparatus according to claim 3, wherein the case has dividers to divide the space and the wind tunnel.

5. The light irradiation apparatus according to claim 4, wherein the intake opening and the exhaust opening of each of the cooling mechanisms are open to the third direction.

6. The light irradiation apparatus according to claim 4, wherein the N is 2, and the exhaust opening of each of the cooling mechanisms is placed closer to the substrate than the intake opening, and is open to the first direction.

7. The light irradiation apparatus according to claim 6, wherein the intake opening of each of the cooling mechanisms is open to the first direction.

8. The light irradiation apparatus according to claim 3, wherein the intake opening and the exhaust opening of each of the cooling mechanisms are open to the third direction.

9. The light irradiation apparatus according to claim 3, wherein the N is 2, and the exhaust opening of each of the cooling mechanisms is placed closer to the substrate than the intake opening, and is open to the first direction.

10. The light irradiation apparatus according to claim 9, wherein the intake opening of each of the cooling mechanisms is open to the first direction.

11. The light irradiation apparatus according to claim 2, wherein the intake opening and the exhaust opening of each of the cooling mechanisms are open to the third direction.

12. The light irradiation apparatus according to claim 2, wherein the N is 2, and the exhaust opening of each of the cooling mechanisms is placed closer to the substrate than the intake opening, and is open to the first direction.

13. The light irradiation apparatus according to claim 12, wherein the intake opening of each of the cooling mechanisms is open to the first direction.

14. The light irradiation apparatus according to claim 12, wherein the intake opening of each of the cooling mechanisms is open to the third direction.

15. The light irradiation apparatus according to claim 1, wherein an intake opening and an exhaust opening of each of the cooling mechanisms are open to the third direction.

16. The light irradiation apparatus according to claim 1, wherein the N is 2, and an exhaust opening of each of the cooling mechanisms is placed closer to the substrate than an intake opening of each of the cooling mechanisms, and is open to the first direction.

17. The light irradiation apparatus according to claim 16, wherein the intake opening of each of the cooling mechanisms is open to the first direction.

18. The light irradiation apparatus according to claim 16, wherein the intake opening of each of the cooling mechanisms is open to the third direction.

19. The light irradiation apparatus according to claim 1, wherein a light source of the plurality of light sources is composed of at least one light emitting diode (LED) device.

20. The light irradiation apparatus according to claim 1, wherein light of the plurality of light sources includes a wavelength applicable to an ultraviolet curable resin.

21. The light irradiation apparatus according to claim 1, wherein the partition extends between ones of the plurality of heat radiation fins, from a base plate in a direction away from the substrate, to connect with at least one panel of the case.

22. The light irradiation apparatus according to claim 21, wherein an upper portion of the partition extends beyond an uppermost surface of the plurality of heat radiation fins, and at least a portion of the at least one panel inclines in a direction of the partition.

* * * * *